US005328137A

United States Patent [19]

Miller et al.

[11] Patent Number: 5,328,137

[45] Date of Patent: Jul. 12, 1994

[54] DISPLAY HANGER

[75] Inventors: Thomas R. Miller, South Haven Township, Van Buren County, Mich.; Brian Bresser, Cincinnati, Ohio

[73] Assignee: Do-It Corporation, South Haven, Mich.

[21] Appl. No.: 961,266

[22] Filed: Oct. 14, 1992

[51] Int. Cl.[5] ..... E04G 5/06

[52] U.S. Cl. ..... 248/223.4; 248/205.3

[58] Field of Search ..... 248/223.4, 224.1, 224.4, 248/225.1, 221.4, 317, 205.3, 683; 40/630

[56] References Cited

U.S. PATENT DOCUMENTS

| | | | |
|---|---|---|---|
| 3,616,096 | 10/1971 | Roeder | 248/205.3 X |
| 4,016,977 | 4/1977 | Krautsack | 206/526 |
| 4,179,138 | 12/1979 | Boedanovic | 248/221.4 X |
| 4,541,598 | 9/1985 | Villanueva et al. | 248/221.4 |
| 4,572,380 | 2/1986 | Langwell | 248/225.1 X |
| 4,693,441 | 9/1987 | Conway | 248/225.1 |
| 4,718,627 | 1/1988 | Fast et al. | 248/225.1 |
| 4,793,486 | 12/1988 | Konopka et al. | 206/438 |
| 4,832,301 | 5/1989 | Hiramoto et al. | 248/205.3 X |
| 4,919,377 | 4/1990 | Alexander et al. | 248/225.1 |
| 5,020,761 | 6/1991 | Good et al. | 248/225.1 X |

*Primary Examiner*—Ramon O. Ramirez

*Attorney, Agent, or Firm*—Flynn, Thiel, Boutell & Tanis

[57] ABSTRACT

A hanger for hanging a product having a flat surface for display is provided in the form of a flat, flexible sheet having a plurality of bonding sections provided adjacent to opposite edges of the sheet which are adapted to be attached to the product. The flat, flexible sheet has a top section, a bottom section, two side sections and an intermediate section bounded by and coplanar with the top, bottom and size sections. Inside the intermediate section is provided a centrally located fold-up portion which is defined by a cut-line and a fold-line. The fold-up portion is rotatable about the fold-line between an initial position at which the fold-up portion is provided below the fold-line and a second position at which an upper portion of the fold-up portion is provided above the fold-line. The upper portion of the fold-up portion contains a member for supporting the hangar and the bottom section of the flat, flexible sheet has a gap provided therein which extends throughout the height of the bottom section to the cut-lines to enable easy access to a bottom edge surface of the fold-up portion.

8 Claims, 2 Drawing Sheets

DISPLAY HANGER

FIELD OF THE INVENTION

This invention relates to a self-adhesive hanger for hanging an article having a flat surface on a rod or hook or, alternatively, from a channel on the edge of a shelf.

BACKGROUND OF THE INVENTION

It is known to display products for sale, such as video cassettes, by attaching them to plastic flat hangers which have an adhesive portion to bond to the product and a hanging means, such as a through-hole, by which the hanger and the product is supported. For example, U.S. Pat. No. 4,832,301, discloses a fold-up, self-adhesive, merchandise display hanger made up of a flat plastic sheet having a bonding section for attachment to a product and a fold-up hanging portion which is rotatable out of the plane of the flat sheet around a fold-line to an upright position at which the hanger and the product can be supported by a support means provided in the fold-up portion.

The hangers disclosed in U.S. Pat. No. 4,832,301 have advantages in that they can be automatically applied to a number of products in its original state without interfering with the automatic packaging of the products into a box. Additionally, the hanger can be automatically applied to each product so that no irregularity of bonding position takes place among the products and the products can always be displayed in desired positions.

However, the hangers disclosed in U.S. Pat. No. 4,832,301 have a disadvantage in that once the hanger is applied to the product, it is difficult to lift up the fold-up portion to an upright position since the fold-up portion is initially contained in the same plane as the rest of the hanger and the user cannot readily engage the bottom edge surface of the fold-up portion to lift it to the upright position. Therefore, there is a need to provide a hang tab which can be automatically applied to a product and contains a fold-up portion which can be easily accessed by the user.

SUMMARY OF THE INVENTION

The object of the present invention is accomplished by providing a hanger for hanging a product having a flat surface. The hanger comprises a flat, flexible sheet having a plurality of bonding sections located adjacent to opposite edges of the sheet, a top section, a bottom section, two side sections and an intermediate section bounded by and coplanar with the top, bottom and side sections. The intermediate section contains a centrally located fold-up portion which is defined by a cut-line and a fold-line provided in the intermediate section. The fold-up portion is rotatable about the fold-line between an initial position at which the fold-up portion is provided below the fold-line and a second, upright position at which an upper portion of the fold-up portion is provided above the fold-line. The upper portion of the fold-up portion contains means for supporting the hanger and the bottom section of the flat, flexible sheet has a gap provided therein which extends throughout the height of the bottom section to the cut-lines to allow easy access to the fold-up portion when the hanger is attached to a product.

BRIEF DESCRIPTION OF THE DRAWINGS

Referring to the attached drawings.

DETAILED DESCRIPTION

Figure 2:
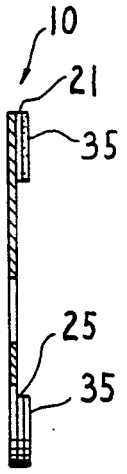
FIG. 2 is a sectional view showing the hanger of FIG. 1.
Figure 1:
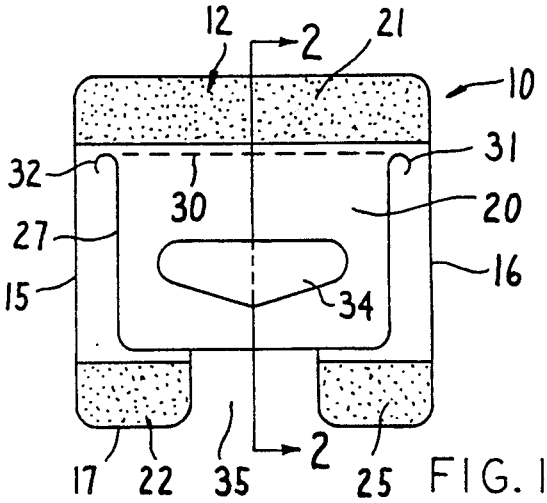
FIG. 1 is a plan view of a first embodiment of the hanger according to the invention in which the bonding sections are provided at the top and bottom sides of the hanger.

Referring to FIG. 1, there is shown a hanger 10, according to the invention, which is adapted to support a product having a flat surface. The hanger 10 comprises a flat, flexible sheet 11 which is preferably made of a synthetic, moldable resin, such as PVC, PETG, polyethylene or polyethylene terephthalate. The sheet 11 is flexible and relatively thin and, for example, can have a thickness on the order of about 0.02 inches.

As shown in FIG. 1, the sheet 11 is substantially rectangular in plan view and comprises a top section 12, side sections 15 and 16, bottom section 17 and an intermediate section 20. In the embodiment of FIG. 1, a plurality of bonding sections 21, 22 and 25 are provided adjacent to opposite lateral edges of the sheet 11.

Figure 4:
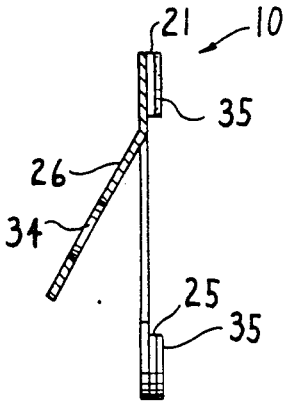
FIG. 4 is a sectional view of the hanger of FIG. 3.
Figure 3:
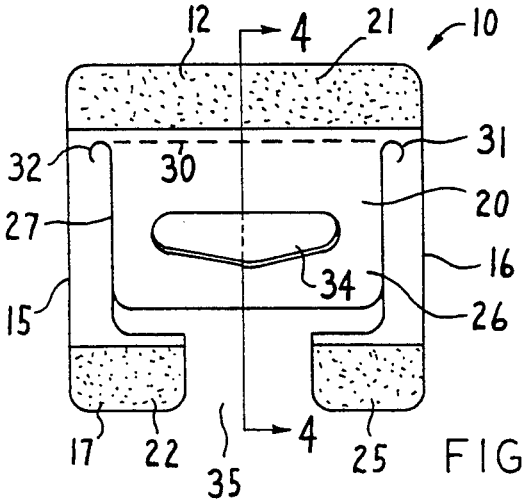
FIG. 3 is a plan view of the hanger of FIG. 1 in which the fold-up portion is being displayed upwardly out of the plane of the hanger.

The intermediate section 20 contains a fold-up portion 26 defined by a cut-line 27 and a fold-line 30. As shown in FIGS. 3 and 4, the cut-line 27 is provided with hinged portions 31, 32 adjacent the fold-line 30 in order to enable the fold-up portion 26 to pivot about the fold-line 30. Although the fold-up portion 26 is shown in the figures as being substantially rectangular, the shape thereof is not critical and it can be provided in other configurations such as a semicircular or triangular configuration.

Figure 7:
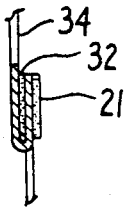
FIG. 7 is a partial sectional view of the hanger of FIG. 5 illustrating an adhesive layer used to secure the fold-up portion in its hanging position.
Figure 6:
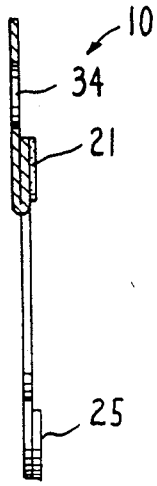
FIG. 6 is a sectional view of the hanger of FIG. 5.
Figure 5:
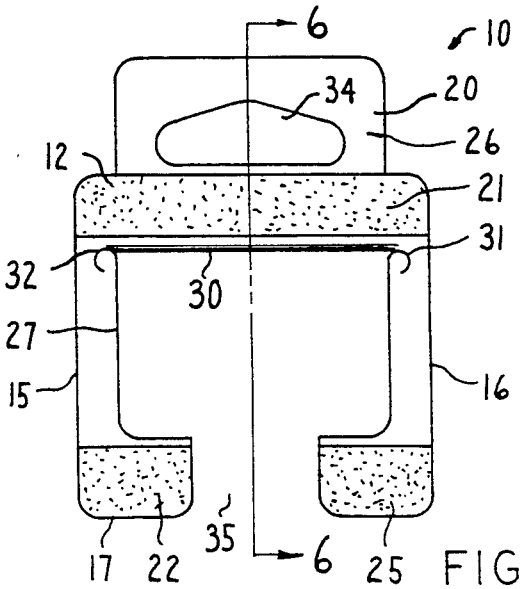
FIG. 5 is a plan view of the hanger of FIG. 1 with the fold-up portion provided at its final hanging position.

As shown in FIGS. 3 through 6, the fold-up portion 26 can be pivoted 180° C. out of the plane of the sheet 11 to an upright position without separating from the sheet 11. A hanging means, such as an opening 34, is provided in the fold-up portion 26 and is adapted to support the hanger 10 and a product adhered thereto when the fold-up portion 26 is in the upright position illustrated in FIG. 5 through 7. In order to help secure the fold-up portion 26 in the upright position, an adhesive layer 32 can be provided at an upper portion of a back surface of the flat sheet 11. Additionally, film sheets 35 can be provided on the bonding sections 21, 22 and 25 to keep them covered until it is desired to adhere a product thereto.

The bottom section 17 of the flat, flexible sheet 11 has a gap 35 provided therein which extends throughout the height of the bottom section 17 and intersects with the cut-line 27. This gap 35 provides easy access to the bottom edge of the fold-up portion 26, even when the hanger 10 is attached to a product.

Figure 9:
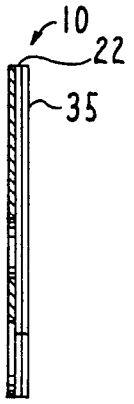
FIG. 9 is a sectional view of the hanger of FIG. 8.
Figure 8:
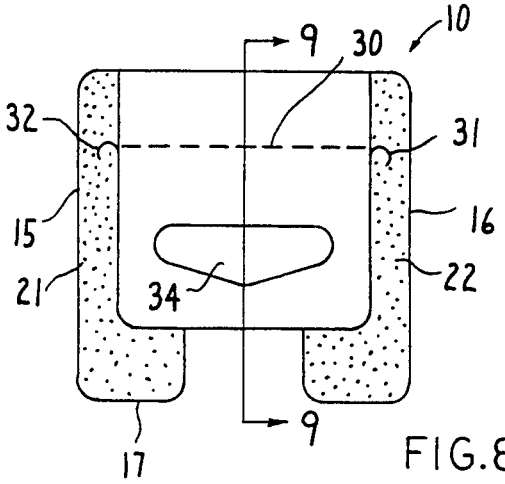
FIG. 8 is a plan view of a hanger of a second embodiment of the present invention in which the bonding portion is provided at the lateral and bottom sides of the hanger.
Figure 11:
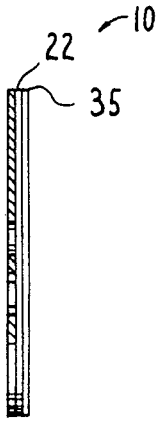
FIG. 11 is a sectional view of the hanger of FIG. 10.
Figure 10:
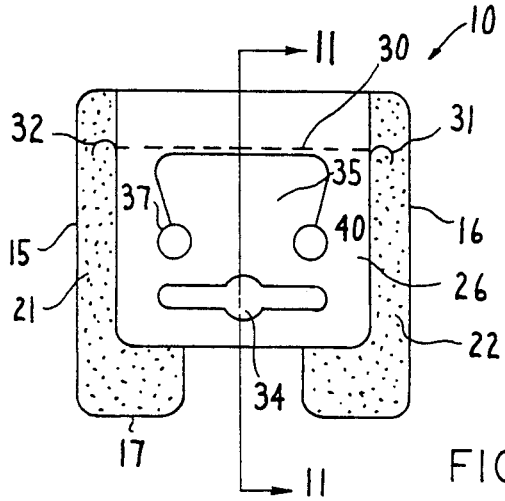
FIG. 10 is a plan view of a hanger of a third embodiment of the present invention having a hanging means adapted to be mounted into a channel.

In the embodiment of the present invention shown in FIGS. 8 and 9, the bonding sections 21 and 22 extend along the side sections 15 and 16 and the bottom section 17 of the flat, flexible sheet 11. This embodiment of the present invention can be used when it is disadvantageous to attach the hanger 10 to a product at the top section 12 of the hanger.

In a third embodiment of the present invention illustrated in FIGS. 10 through 13, the fold-up portion 26 is provided with a centrally located tab portion 35 defined by a cut-line 36 and openings 37 and 40. The openings 37 and 40 facilitate the hinging of the tab portion 35 with respect to the remainder of the fold-up portion 26. The tab 35 is capable of being pivotably bent out of the plane of the fold-up portion 26 about the region defined between holes 37 and 40. However, at all times, the tab portion 35 remains integrally attached to the remainder of the fold-up portion 26.

Figure 13:
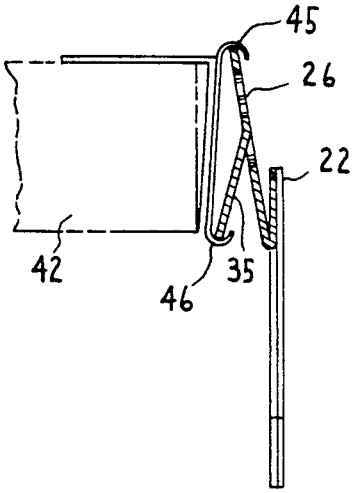
FIG. 13 is a partial sectional view of the hanger of FIG. 12.
Figure 12:
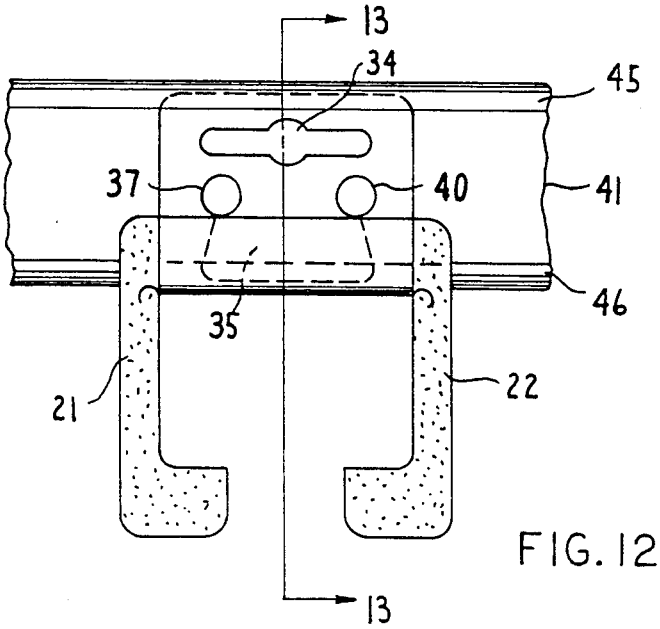
FIG. 12 is a plan view of the hanger of FIG. 10 mounted in a channel.

FIGS. 12 and 13 illustrate how the hanger 10 corresponding to the third embodiment of the present invention can be mounted. The hanger 10 is mounted in a channel 41 on the edge of a shelf 42. The channel 41 can be of the conventional type used for displaying prices in supermarkets and convenience stores. The channel 41 has upper and lower flanges 45 and 46 and a central wall 47 extending therebetween. The hanger 10 is mounted in the channel 41 by rotating the fold-up portion 26 about the fold-line 30 until the fold-up portion 26 is provided in a upright position. The tab portion 35 is then flexed out of the plane of the fold-up portion 26 toward the channel 41 and inserted into a pocket formed by the lower flange 46. The upper edge of the fold-up portion is then also flexed toward the channel 41 and inserted into a pocket formed by the upper flange 45. In this type of mounting arrangement, a product adhered to the bonding sections 21 and 22 is suitably mounted for display.

Although particular embodiments of the invention have been described, it would be within the skill of the art to made modifications therein and still fall within the scope of the present invention.

The embodiments of the invention in which an exclusive property or privilege is claimed are defined as follows:

1. A hanger comprising:

a flat, flexible sheet having a plurality of bonding sections located adjacent to opposite edges of said sheet, a top section, a bottom section, two side sections and an intermediate section bounded by and coplanar with said top, bottom and side sections, said intermediate section comprising a centrally located fold-up portion defined by a cut-line and a fold-line in said intermediate section, said fold-up portion being rotatable about said fold-line between an initial position at which said fold-up portion is provided below said fold-line and a second position at which an upper portion of said fold-up portion is provided above said fold-line, said upper portion of said fold-up portion comprising means for supporting said hanger and said bottom section of said flat, flexible sheet having a gap provided therein which extends throughout the height of said bottom section to said cut-line.

2. A hanger as claimed in claim 1, wherein said bonding sections comprise adhesive layers which extend parallel to said fold-line.

3. A hanger as claimed in claim 1, wherein said bonding sections comprise adhesive layers which extend perpendicular to said fold-line.

4. A hanger as claimed in claim 1, wherein said means for supporting said hanger comprises an opening provided in said upper portion of said fold-up portion.

5. A hanger as claimed in claim 1, wherein said means for supporting said hanger comprises a hinged tab having a free edge provided adjacent to said fold-line, said tab being flexible relative to said fold-up portion so that said free edge and an upper edge surface of said fold-up upper portion can be inserted in channels in a stationary support.

6. A hanger as claimed in claim 1, wherein said tab free edge and said fold line are colinear.

7. A hanger as claimed in claim 1, wherein said top section of said flat, flexible sheet is provided with an adhesive layer to fixedly secure said fold-up portion in said second position.

8. A hanger and product assembly comprising:

a product having a top side, a bottom side, a longitudinal surface joining the top and bottom sides, and a center of gravity between the top side and the bottom side; and a hanger comprising a flat, flexible sheet having a plurality of bonding sections located adjacent to opposite edges of said sheet, a top section, a bottom section, two side sections and an intermediate section bounded by and coplanar with said top, bottom and side sections, said intermediate section comprising a centrally located fold-up portion defined by a cut line and a fold-line in said intermediate section, said fold-up portion being rotatable about said fold-line between an initial position at which said fold-up portion is provided below said fold-line and a second position at which an upper portion of said fold-up portion is provided above said fold-line, said upper portion of said fold-up portion comprising means for supporting said assembly and said bottom section of said flat, flexible sheet having a gap contained therein which extends throughout the height of said bottom section to said cut-line, said product being attached to said hanger at at least one of said plurality of bonding sections.

* * * * *